US006129173A

United States Patent [19]

Panton

[11] Patent Number: 6,129,173

[45] Date of Patent: Oct. 10, 2000

[54] PERSONAL REMOVABLE MOUTHPIECE FOR A VOICE AMPLIFICATION INSTRUMENT AND METHOD OF USING SAME

[76] Inventor: Paula Panton, 400 Coral Ave., Melbourne Beach, Fla. 32951

[21] Appl. No.: 09/291,313

[22] Filed: Apr. 15, 1999

[51] Int. Cl.[7] ..... G10K 11/00

[52] U.S. Cl. ..... 181/21; 181/177

[58] Field of Search ..... 181/18, 21, 22, 181/141, 177, 190; 84/355, 398, 399, 453; 379/452

[56] References Cited

U.S. PATENT DOCUMENTS 3,744,365 7/1973 Kordula ..... 84/398
4,570,038 2/1986 Tinelli ..... 181/141
5,682,424 10/1997 Alcorn, Sr. ..... 379/452

*Primary Examiner*—Khanh Dang
*Attorney, Agent, or Firm*—Ronald P. Kananen; Rader, Fishman & Grauer

[57] ABSTRACT

A personal removable mouthpiece can be slipped over the mouthpiece of a voice amplification instrument. An aperture in the removable mouthpiece allows a user to use the voice amplification instrument without the user's mouth coming into contact with the instrument. When a second user begins using the instrument, the removable mouthpiece is replaced thereby preventing the second user from being exposed to any communicable disease of the first user. The removable mouthpiece includes inner and outer annular walls with an annular opening defined therebetween into which the mouthpiece of the voice amplification instrument is inserted. The inner and outer annular walls are connected at bottom ends thereof by a bottom annular wall.

17 Claims, 3 Drawing Sheets

PERSONAL REMOVABLE MOUTHPIECE FOR A VOICE AMPLIFICATION INSTRUMENT AND METHOD OF USING SAME

FIELD OF THE INVENTION

The present invention relates to the field of voice amplification. More specifically, the present invention relates to the field of personal safety and hygiene in the use of voice amplification instruments by multiple people.

BACKGROUND OF THE INVENTION

In a variety of situations, it is necessary or desirable to amplify the human speaking voice. For example, lifeguards on beaches or at swimming pools frequently use a voice amplification instrument to convey warnings or instructions to swimmers. Similarly, cheerleaders and mascots at sporting events often use a voice amplification instrument to shout instructions or encouragement to fans and players.

The two most common types of voice amplification instruments are megaphones and bullhorns. With either type of instrument, the user places his or her mouth in or against a mouthpiece of the instrument. With the voice amplification instrument at the mouth of the user, anything the user says will be amplified for the hearers.

A problem arises when two or more different people make use of the same voice amplification instrument. After the first person has placed his or her mouth in or against the mouthpiece of the voice amplification instrument, the second person to use the instrument is at risk of exposing him or herself to any communicable disease that the first person has. The second person's reluctance to be exposed to this risk may impede or impair that person's use of the voice amplification instrument.

Consequently, there is a need in the art for a device and method for preventing the communication of disease through the shared use of a voice amplification instrument.

SUMMARY OF THE INVENTION

It is an object of the present invention to meet the above-described needs and others. Specifically, it is an object of the present invention to provide a device that prevents the communication of disease through the shared use of a voice amplification instrument. It is a further object of the present invention to provide a method of preventing such communication of disease through the shared use of a voice amplification instrument.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve these stated and other objects, the present invention may be embodied and described as a method of improving the appearance, comfort and sanitation of a voice amplification instrument by placing a removable mouthpiece specific to a particular user on or over the existing mouthpiece of the voice amplification instrument. This may be done by slipping the removable mouthpiece over the mouthpiece of the voice amplification instrument such that friction between the removable mouthpiece and the mouthpiece of the instrument maintains the removable mouthpiece in position.

To allow a user to still make unrestrained use of the voice amplification instrument, the method includes aligning an aperture through the removable mouthpiece with a voice input portion of the voice amplification instrument. The removable mouthpiece may also server to cushion the existing mouthpiece of the voice amplification instrument.

When a second user wishes to use the voice amplification instrument without running the risk of being exposed to a communicable disease of the first user, the method includes replacing the removable mouthpiece with a second removable mouthpiece for the second user.

The present invention also encompasses the removable mouthpiece itself. In a preferred embodiment, the removable mouthpiece is constructed to include an inner annular wall; and an outer annular wall. A recess is defined between the inner and outer annular walls which is sized to receive the existing mouthpiece of the voice amplification instrument therein so as to mount the removable mouthpiece on the voice amplification instrument.

A bottom annular wall runs between and connects the inner and outer annular walls. The bottom annular wall is substantially perpendicular to the inner and outer annular walls.

Preferably, the removable mouthpiece is made from a single continuous sheet of material which is shaped to provide the inner and outer annular walls and the bottom annular wall. Preferably, this material is PVC.

The removable mouthpiece of the present invention also has an aperture through it. The aperture is enclosed by the inner annular wall. This aperture permits acoustic energy to pass through the removable mouthpiece into the voice amplification instrument.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Figure 1:
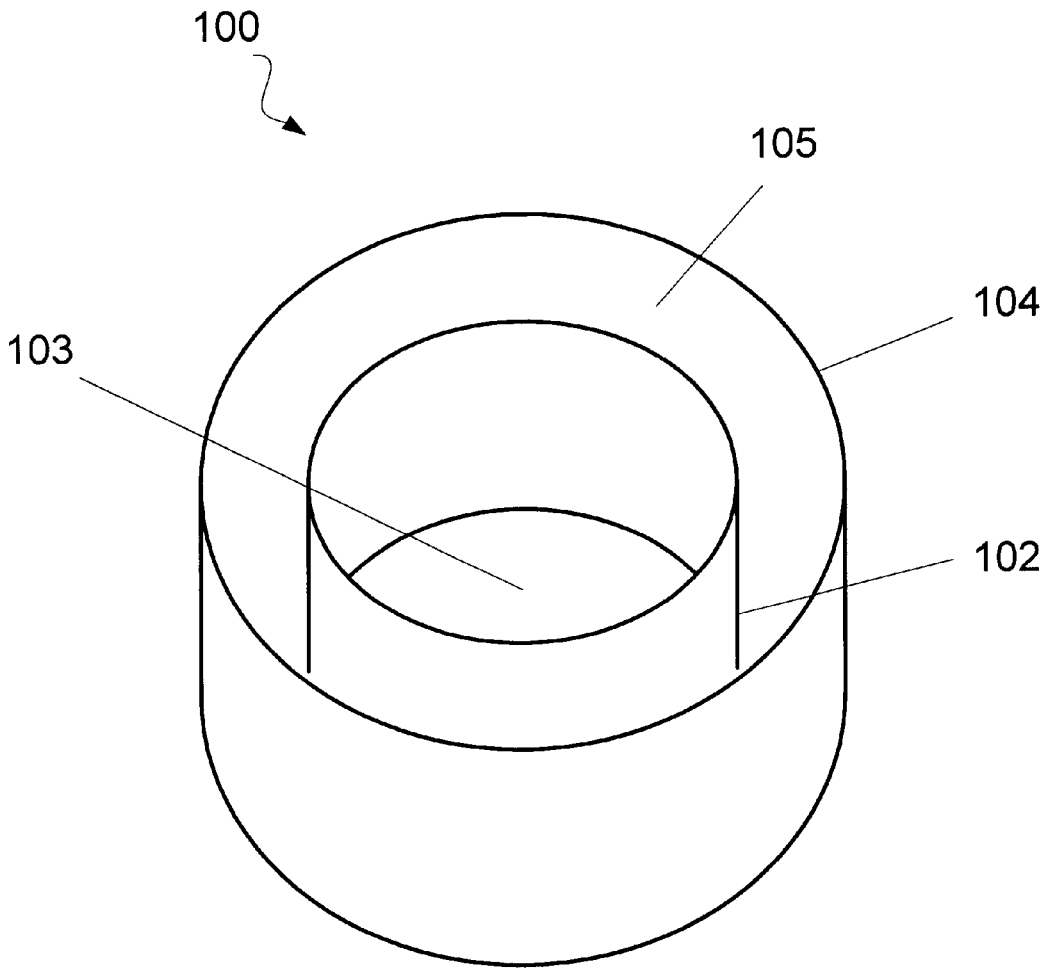
FIG. 1 is a plan view of a personal, removable mouthpiece for a voice amplification instrument according to the present invention.

Stated in broad principle, the present invention provides a personal, removable mouthpiece that can be placed on and over the mouthpiece of a voice amplification instrument. Each person who uses the instrument can cover the instrument's mouthpiece with their own personal, removable mouthpiece so as to prevent the communication of any disease through the shared use of the instrument. The present invention also encompasses this method of using such a personal, removable mouthpiece to enhance the safety and hygiene of using and sharing a voice amplification instrument.

Using the drawings, the preferred embodiments of the present invention will now be explained. In the drawings, like reference numerals indicate identical structure of elements.

FIG. 1 illustrates a personal, removable mouthpiece (100) according to the present invention. As shown in FIG. 1, the mouthpiece (100) comprises an outer annular wall (104) and an inner annular wall (102). The inner (102) and outer (104) annular walls are preferably continuously connected at the lower ends thereof by a bottom annular wall (301) shown in FIG. 3. As will be appreciated by those skilled in the art, the various walls (104, 102 and 301) of the mouthpiece (100) may be integrally formed as a single unit from a single material.

The inner annular wall (102) defines a circular aperture (103) through the center of the mouthpiece (100). An annular opening (105) is defined between the inner (102) and outer (104) annular walls.

Figure 2:
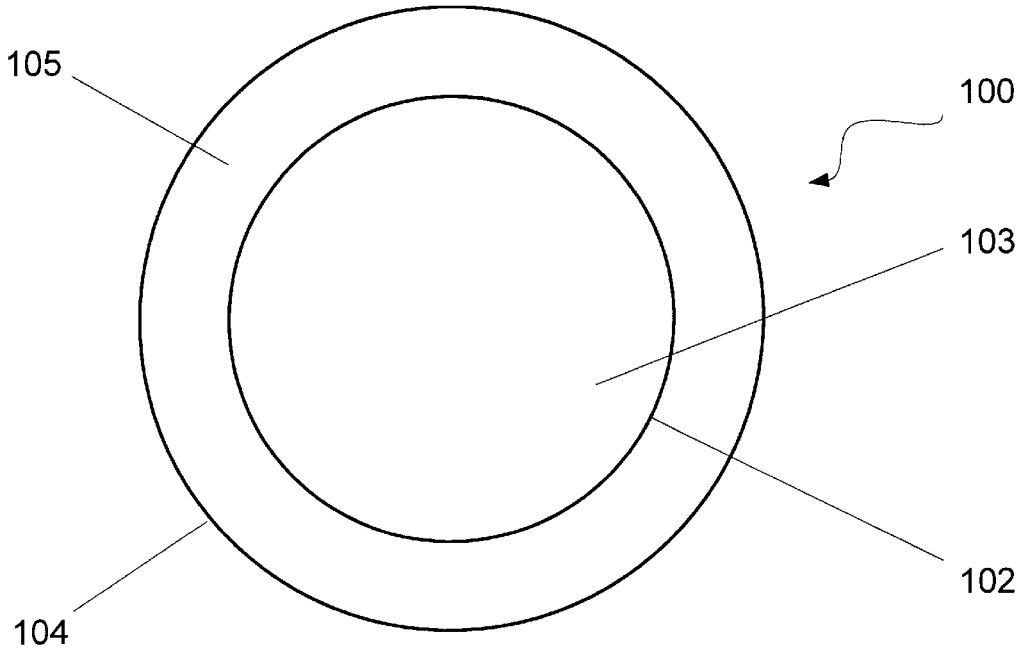
FIG. 2 is a top view of the mouthpiece of FIG. 1.

FIG. 2 illustrates a top view of the mouthpiece (100) shown in FIG. 1. As shown in FIG. 2, the inner annular wall (102) is generally concentric with the outer annular wall (104). The circular aperture (103) is defined by the inner annular wall (102) and opens completely through the mouthpiece (100). An annular opening (105) is defined between the inner (102) and outer (104) annular walls.

Figure 3:
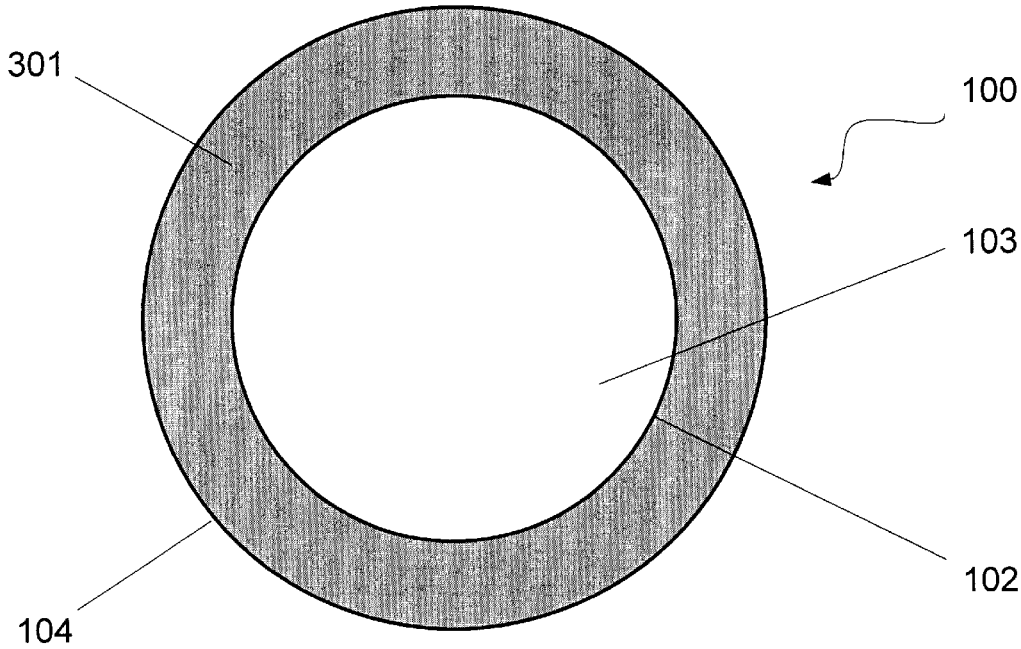
FIG. 3 is a bottom view of the mouthpiece of FIG. 1.

FIG. 3 illustrates a bottom view of the mouthpiece (100). As shown in FIG. 3, the annular opening (105) is bounded and closed by the bottom annular wall (301). The bottom annular wall (301) extends between the bottom portions of the inner (102) and outer (104) annular side walls. The aperture (103) extends completely through the mouthpiece (100).

Figure 4:
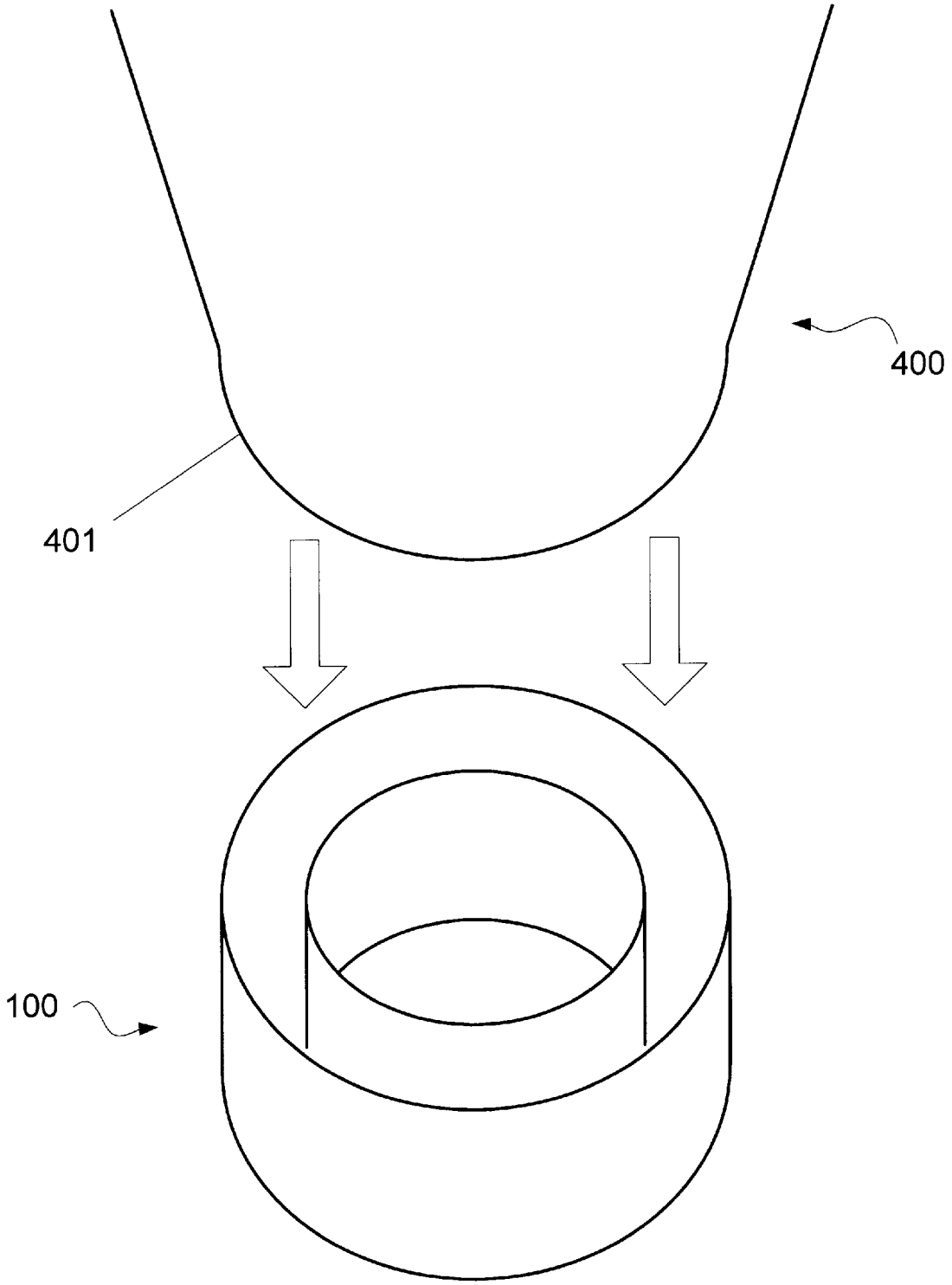
FIG. 4 is an illustration of the use of the mouthpiece of FIG. 1 on a voice amplification instrument.

FIG. 4 illustrates the method of using the mouthpiece (100) of the present invention. As shown in FIG. 4, the removable mouthpiece (100) is disposed on the mouthpiece (401) of a voice amplification instrument (400). The voice amplification instrument (400) may be a megaphone, a bullhorn, or any other voice amplification instrument.

The mouthpiece (401) of the voice amplification instrument (400) is inserted or slipped into the annular opening (105) of the removable mouthpiece (100) as shown in FIG. 4. The aperture (103) of the mouthpiece (100) is then aligned so as to allow the user to speak into the voice amplification instrument (400) while the removable mouthpiece (100) prevents the user's mouth from coming into physical contact with the mouthpiece (401) of the instrument (400).

When a new user begins using the instrument (400), the mouthpiece (100) is removed and replaced with a mouthpiece of the second user. In this way, the second user runs little or no risk of being exposed to a communicable disease of the first user.

The mouthpiece (100) can be made of virtually any material. However, flexible materials with a sufficient frictional coefficient to engage the mouthpiece (401) of the voice amplification instrument (400) without slippage are preferred. For example, medical grade polyvinyl chloride (PVC) is a preferred material for the mouthpiece (100).

The mouthpiece (100) can be sized to fit any voice amplification instrument desired. However, a preferred size for the mouthpiece (100) is as follows. The outer annular wall (104) has a diameter of 2.5 inches. The inner annular wall (102) has a diameter of 1.75 inches. The height of the inner (102) and outer (104) annular walls is 1.00 inch. The thickness of the material from which the mouthpiece (100) is made, i.e., the thickness of the inner (102), outer (104) and bottom (301) annular walls, is 0.060 inches.

The mouthpiece (100) of the present invention can also serve to increase the comfort of using a voice amplification instrument. For example, the removable mouthpiece (100) may cushion the mouthpiece (401) of the voice amplification instrument (400).

Additionally, the mouthpiece (100) of the present invention may increase the aesthetics of the instrument (400). For example, if the mouthpiece (100) is being used by cheerleaders, the mouthpiece (100) may be colored with the color or colors of the team for which the cheerleaders are cheering. Other significance may attach to the appearance of the mouthpiece (100) such as different colors for different users or different groups of users.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A method of improving the appearance, comfort and sanitation of a bullhorn or megaphone used as a voice amplification instrument comprising placing a removable mouthpiece specific to a particular user on a mouthpiece of said bullhorn or megaphone so as to minimize spread of communicable diseases among different users of said voice amplification instrument.

2. The method of claim 1, wherein said placing comprises slipping said removable mouthpiece over said mouthpiece of said voice amplification instrument such that friction between said removable mouthpiece and said mouthpiece of said instrument maintains said removable mouthpiece in position.

3. The method of claim 1, further comprising aligning an aperture through said removable mouthpiece with a voice input portion of said voice amplification instrument.

4. The method of claim 1, further comprising replacing said removable mouthpiece with a second removable mouthpiece for a second user.

5. The method of claim 1, further comprising cushioning said mouthpiece of said voice amplification instrument with said removable mouthpiece.

6. A removable mouthpiece for a voice amplification instrument comprising:

an inner annular wall; and an outer annular wall;

wherein a recess is defined between said inner and outer annular walls which is sized to receive a mouthpiece integral to a bullhorn or megaphone as said voice amplification instrument so as to mount said removable mouthpiece on said integral mouthpiece of said bullhorn or megaphone.

7. The mouthpiece of claim 6, further comprising a bottom annular wall between and connecting said inner and outer annular walls, said bottom annular wall being substantially perpendicular to said inner and outer annular walls.

8. The mouthpiece of claim 7, wherein said removable mouthpiece is made from a single continuous sheet of material which is shaped to provide said inner and outer annular walls and said bottom annular wall.

9. The mouthpiece of claim 8, wherein said material is PVC.

10. The mouthpiece of claim 6, further comprising an aperture therethrough enclosed by said inner annular wall for permitting acoustic energy to pass through said removable mouthpiece into said bullhorn or megaphone.

11. The mouthpiece of claim 6, wherein said removable mouthpiece is made of PVC.

12. The mouthpiece of claim 11, wherein said removable mouthpiece is made from a single continuous sheet of PVC which is shaped to provide said inner and outer annular walls.

13. A means for improving the comfort, aesthetics and sanitation of a voice amplification instrument comprising:

said voice amplification instrument which amplifies utterances and vocalizations of a user so as to increase a range over which said utterances and vocalizations can be heard and understood by listeners, wherein said voice amplification instrument is not a telephone;

a removable cover for covering a mouthpiece integral to said voice amplification instrument while still permitting the use thereof.

14. The means of claim 1, wherein said means for causing a friction fit comprising inner and outer annular walls between which said integral mouthpiece is placed so as to retain said cover on said integral mouthpiece.

15. The means of claim 13, further comprising an aperture in said cover for passing acoustic energy through said cover and into said voice amplification instrument.

16. The means of claim 13, wherein said removable cover further comprising means for causing a frictional fit between said cover and said integral mouthpiece so as to retain said cover on said integral mouthpiece.

17. The means of claim 13, wherein said voice amplification instrument is a bullhorn or megaphone.

* * * * *